US005510870A

United States Patent [19]

Kashino et al.

[11] Patent Number: 5,510,870

[45] Date of Patent: Apr. 23, 1996

[54] SHEET-LIKE MATERIAL PROCESSING APPARATUS AND PHOTOSENSITIVE MATERIAL PROCESSING APPARATUS

[75] Inventors: Teruo Kashino; Shinichi Otani; Kazuhiro Nemoto; Futoshi Wada, all of Hino, Japan

[73] Assignee: Konica Corporation, Tokyo, Japan

[21] Appl. No.: 315,932

[22] Filed: Sep. 29, 1994

[30] Foreign Application Priority Data

Oct. 8, 1993 [JP] Japan ..... 5-253466

[51] Int. Cl.[6] ..... G03D 13/00

[52] U.S. Cl. ..... 354/298; 354/320; 354/321; 354/324; 354/325

[58] Field of Search ..... 354/324, 325, 354/328, 298, 319–323; 430/398–400, 30, 393, 455; 134/64 P, 64 R, 122 P, 122 R

[56] References Cited

U.S. PATENT DOCUMENTS 5,148,206 9/1992 Shidara ..... 354/328 X
5,168,296 12/1992 Nakamura et al. ..... 354/324 X
5,298,373 3/1994 Sasaoka et al. ..... 430/429
5,302,995 4/1994 Hayashi ..... 354/324 X

FOREIGN PATENT DOCUMENTS

0559028A1 9/1993 European Pat. Off. .
WO92/12465 7/1992 WIPO .

OTHER PUBLICATIONS

Patents Abstract of Japan, vol. 12, No. 32 (P–661) Jan. 30, 1988 & JP–A–62 183 460 (Fuji Photo Film).

*Primary Examiner*—D. Rutledge
*Attorney, Agent, or Firm*—Frishauf, Holtz, Goodman, Langer & Chick

[57] ABSTRACT

In an apparatus for processing a photosensitive material, a flow of the processing solution is created on a surface of the photosensitive material, wherein a synthetic flow speed on a surface of the photosensitive material is not less than 80 mm/sec, the synthetic flow speed is a composition of the created flow speed component of the processing solution and a conveyance speed component by a conveyance device.

21 Claims, 10 Drawing Sheets

SHEET-LIKE MATERIAL PROCESSING APPARATUS AND PHOTOSENSITIVE MATERIAL PROCESSING APPARATUS

BACKGROUND OF THE INVENTION

The present invention relates to a processing apparatus in which photosensitive material or sheet-like material is processed using processing solutions for development processing of a photographic film, print, etc., or a photosensitive printing sheet, heat sensitive sheet, etc., or fixing processing, stabilizing processing of them. Specifically, the present invention relates to a processing apparatus in which a sheet-like material or photosensitive material is rapidly processed.

Conventionally, dimensions of a development processing tank are inevitably increased so that the photosensitive material can be satisfactorily developed, in the same manner as a processing apparatus such as a development processing apparatus for photosensitive material, for example, so-called automatic developing apparatus.

FIG. 12 is a central sectional view showing the outline of the internal structure of a general automatic developing processor of photosensitive material. In this case, the apparatus has many conveyance rollers and a long conveyance path, so that the apparatus becomes larger.

In FIG. 12, the conveyance path of photosensitive material 2 is shown by a one-dotted chain line in a deep processing tank 100. Many conveyance rollers R for conveying the photosensitive material are arranged along the conveyance path. The photosensitive material 2 is vertically conveyed being disposed between conveyance rollers R as shown in the drawing.

Conventionally, in the conveyance direction, the number of conveyance rollers which are in contact with the conveyed photosensitive material 2 is increased in order to eliminate uneven processing and uneven development so that a surface inhibiting layer on the surface of the photosensitive material 2 is destroyed by the surface contact of the conveyance rollers R with the photosensitive material 2. Therefore, the development processing speed of the photosensitive material 2 is increased, so that the processing efficiency is enhanced. Further, the length of the conveyance path is increased so that the development is completely conducted until delivery of the photosensitive material 2.

Specifically, when the photosensitive material is processed, the inhibiting material is generated accompanied with processing reaction of the photosensitive material, and the inhibiting layer is formed on the surface of the processed photosensitive material. Accordingly, fresh processing solution (processing solution which can conduct development processing) is not supplied onto the surface of the photosensitive material, so that the speed-up of the development processing is limited. Also in development processing, fixing processing or other processing, or in a recording medium recorded by heat, etc., such as the photosensitive material, even when the processing solution is supplied onto the recording surface in chemical processing to visualize a formed latent image, reaction product material remains on the surface and obstructs the next processing, which is a problem not only for the photosensitive material but also for other materials.

Accordingly, in order to solve the foregoing problem, a long conveyance path is provided in a deep processing tank, and the development processing is promoted by the following processing: the surface inhibiting layer, which remains readily on the surface of the photosensitive material during the conveyance, is destroyed by frequent contact of the conveyance rollers and removed. Accordingly, the number of the conveyance rollers is increased, resulting in an increase of size and cost.

In contrast to this, in the automatic developing apparatus shown in FIG. 12, the speed of liquid flow is increased so that the speed of development processing is enhanced. However, there is an occasional case in that nonuniformity occurs on an image. In this case, the quality is lowered so that an acceptable product can not be obtained, which remains as a problem. Further, the following processing has been tried: the direction of flow of the processing solution in the processing tank is directed almost perpendicular to the conveyance direction of the photosensitive material so that the processing speed can be enhanced. However, in these trials, the resultant synthetic flow speed on the surface of the photosensitive material, factors of which are the conveyance speed of the photosensitive material and the flow speed of the processing solution in the automatic developing apparatus, is at the most 40 to 60 mm/sec because the image quality is considered to be the most important criterion. However, satisfactory image quality can not be obtained, so that improvement of the process is still necessary.

Specifically, in a small-sized automatic developing apparatus, unevenness of the speed of the liquid flow easily occurs and the image quality is affected thereby, and as a result, it is necessary that the number of roller faces (the number of contact faces of conveyance rollers) is increased in order to maintain the image quality. Even in the case where liquid flow is provided laterally to the conveyance direction of the photosensitive material, a satisfactory image quality can not be obtained because this liquid flow is provided from one side. That is, a difference of the speed of the liquid flow is caused between the outlet and the inlet in the flow speed distribution of the development processing solution which flows laterally with respect to the conveyance direction of the photosensitive material; the processing solution tends to remain on the inlet side; and a difference of concentration of the developing solution results, so that the entire surface of photosensitive material can not be evenly developed.

SUMMARY OF THE INVENTION

The present invention has been developed in order to solve shortcomings of a processing apparatus in which development processing, and the like, of the foregoing photosensitive material or other sheet-like materials are conducted using processing solutions. The first object of the present invention is to provide a processing apparatus in which the above-mentioned materials can be rapidly processed while maintaining the high image quality. The second object of the invention is to conduct high quality image processing without causing uneven development, etc.. Further, the third object of the present invention is to accomplish down-sizing of the processing apparatus while maintaining high quality image processing performance.

The above-described objectives can be attained by the following structure. Initially, a photosensitive material processing apparatus comprising: a processing tank for accommodating a processing solution for processing the photosensitive material a conveyance means for conveying the photosensitive material in the processing tank; and a liquid flow forming means for forming the liquid flow of the processing solution in the direction perpendicular to the conveyance direction of the photosensitive material and along the surface of the photosensitive material, which is characterized in that the speed of the liquid flow formed by the liquid flow forming means is higher than 80 mm/sec on the photosensitive material conveyance path. Specifically, the speed of the liquid flow formed by the liquid flow forming means is preferably higher than 80 mm/sec in the entire range of the photosensitive material conveyance path. Further, in the liquid flow forming means, an outlet and inlet of the liquid flow can be structured as a liquid circulation means, in which the outlet and inlet are respectively formed opposite to each other in the direction of the width of the photosensitive material with respect to the conveyance direction of the photosensitive material. By the means described above, even when the processing tank is shallow, the image quality can be sufficiently maintained and the processing speed can be enhanced.

Further increase of the processing speed and image quality can be attained by the photosensitive material processing apparatus comprising: a processing tank for accommodating a processing solution for processing the photosensitive material; a conveyance means for conveying the photosensitive material in the processing tank; and a liquid flow forming means for forming the liquid flow of the processing solution in the direction perpendicular to the conveyance direction of the photosensitive material and along the surface of the photosensitive material, and the processing apparatus in which paired liquid flows having respectively opposed speed components with respect to the direction perpendicular to the photosensitive material conveyance direction and along the the surface of the photosensitive material, are formed along the photosensitive material conveyance direction by the liquid flow forming means and thereby the photosensitive material is processed. The image quality is further increased and overall apparatus dimensions can be reduced without lowering the image quality when the absolute values of the speed components of pairs of opposed liquid flows are made to have the relationships in which they compensate each other.

Further, pairs of opposed liquid flows having speed components in respective opposite directions with respect to the width of the material in the photosensitive material conveyance direction, which are formed by the liquid flow forming means, may be structured in such a manner that their flow speed distribution is symmetrical in the photosensitive material conveyance path.

In this case, the processing speed is increased when the speed of liquid flows having opposed speed components in the opposite directions is higher than 80 mm/sec in the photosensitive material conveyance path.

It is preferable that pairs of the liquid flows having opposed speed components in the respective opposite directions in the direction perpendicular to the photosensitive material conveyance direction and along the surface of the photosensitive material, which are formed by the liquid flow forming means, are formed along the entire range of the conveyance direction on the photosensitive material conveyance path in the processing tank. However, the present invention is not limited to the above-described structure, and the opposed pairs of liquid flows may be formed only in a portion in which the image quality is mostly affected as in the first half portion of the processing tank.

The following conditions are also preferable: the liquid flow forming means is also the liquid circulation means having an outlet and inlet for the liquid flow; the outlet and inlet are formed in positions opposite to each other in the direction of the width with respect to the conveyance direction of the photosensitive material; the outlet and inlet of the liquid circulation means are formed in positions opposite to each other in the direction of the width of the photosensitive material with respect to the conveyance direction of the photosensitive material, and pairs of the liquid circulation means, which form liquid flows in opposite directions, are provided in the conveyance direction of the photosensitive material; and at least pairs of outlets are arranged in mostly central portions in the direction of the width with respect to the conveyance direction of the photosensitive material in such a manner that they are respectively directed in opposing directions, and inlets are arranged in positions shifted along the central portions in the conveyance direction of the photosensitive material. Further, it is also preferable that the outlet of the liquid circulation means is arranged in the position offset from the inlet in the conveyance direction of the photosensitive material.

It is preferable for speed-up of processing to form the processing tank to be shallow. Thereby, the liquid flow perpendicular to the conveyance direction of the photosensitive material is uniformly formed, and the pair of liquid flows compensate each other, so that the entire surface of the photosensitive material can be more uniformly processed.

Further, high speed and high quality image processing can be conducted by a sheet-like material processing apparatus which is provided with: a processing tank for accommodating a processing solution for processing the sheet-like material; a conveyance means for conveying the sheet-like material in the processing tank; and a liquid flow forming means for forming the liquid flow of the processing solution in the direction perpendicular to the conveyance direction of the sheet-like material and along the surface of the sheet-like material, and the apparatus in which the speed of the liquid flow formed by the liquid flow forming means is higher than 80 mm/sec on the sheet-like material conveyance path, and pairs of liquid flows having opposed speed components in the opposite direction with respect to the direction perpendicular to the sheet-like material conveyance direction and along the surface of the sheet-like material, are formed along the sheet-like material conveyance direction by the liquid flow forming means, and thereby the sheet-like material is processed.

Next, the operation of development processing of the photosensitive material will be explained as an example.

When it is a requirement to have a small processing tank, in which the processing solution for processing the photosensitive material is accommodated, the developing performance is lowered and the image quality tends to also be lowered. Therefore, conventionally, the photosensitive material is processed in larger-sized apparatus. That is, conventionally, the speed-up of processing is abandoned for the above-described reasons, and the automatic developing apparatus is inherently larger. The present invention can provide an automatic developing apparatus as a photosensitive material processing apparatus in which the image quality is not lowered, the image can be satisfactorily developed, and the processing speed can be enhanced.

In the present invention, it is a requirement to form the liquid flow of the processing solution in the direction along the surface of the photosensitive material from the direction perpendicular to the conveyance direction of the photosensitive material with respect to its conveyance path in the processing tank. Specifically, in the present invention, the speed of the liquid flow is higher than 80 mm/sec, which has not been conventionally adopted in this type of apparatus, on the conveyance path of the photosensitive material. At this speed of liquid flow, it is conventionally accepted that uneven processing occurs. However, the photosensitive material processing apparatus, in which the developing image quality is not unexpectedly lowered, can be realized. In order to realize a more sufficient apparatus, the speed of the liquid flow is raised to more than 80 mm/sec over the entire region on the conveyance path of the photosensitive material.

In practice, it is a simple method that liquid flow from the direction perpendicular to the conveyance path of the photosensitive material is formed between outlets and inlets provided on both sides of the processing tank so that the processing liquid is circulated using a pump, etc. When pairs of liquid flows are formed in the direction perpendicular to the conveyance direction of the photosensitive material conveyed in the processing tank, and are formed in the manner that they have speed components in respective opposite directions and compensate each other, or when the apparatus is structured so that the speed distribution of pairs of liquid flow is symmetrical on the conveyance path of the photosensitive material, uneven development in the direction of the width of the photosensitive material does not result, and the material is efficiently developed. As a result, the development processing can be completed in a short conveyance path, and the overall dimensions of the apparatus can be greatly reduced.

When the resultant synthetic flow speed on the conveyance path of the photosensitive material is higher than 80 mm/sec, high speed development can be realized. In addition, uneven development processing does not occur.

Conventionally, in larger-sized apparatus, the processing efficiency is increased when the number of roller faces is increased, and further, the uneven development is reduced. In the present invention, the processing efficiency is enhanced, and further, an image which has no uneven development and is well-balanced over its width can be obtained even when the apparatus is small-sized, that is, even when the length of the conveyance path is short. Even when the liquid is supplied in only one direction, uneven development hardly occurs when the resultant synthetic flow speed on the conveyance path of the photosensitive material is considerably high. Of course, when the speed of pairs of liquid flows supplied from both the left and right sides in the direction of the width is balanced so that differences between developing efficiencies are not caused, development, by which superior processed images are obtained, can be conducted.

In this way, when the resultant synthetic flow speed on the conveyance path of the photosensitive material is considerably high, an inhibiting material produced on the surface of the photosensitive material during the previous development processing is jetted away, and new processing solution is continuously fed to the surface of the photosensitive material. Accordingly, development is more efficiently conducted. The reasons why satisfactory development can not be conducted by conventional lateral jetting at low flow speed, are not clear, but it is supposed that uneven development tends to occur because the ratio of variations of the flow speed is large in the direction of width. In contrast to this, when a high flow speed is maintained in the present invention, there is a relatively small difference between development quality at the near side of the outlet and that at the far side of the outlet. Further, as shown by the experimental data, which is described later, when the flow speed is higher than a certain threshold value, great contribution to the development is found. In this case, pairs of liquid flows are formed over the entire region in the conveyance direction of the conveyance path of the photosensitive material in the processing tank.

BRIEF DESCRIPTION OF THE DRAWINGS

FIG. 2 (*b*) is a laterally sectional view specifically showing an outline of conditions of the liquid flow in the conveyance path in a processing tank.

PREFERRED EMBODIMENT OF THE INVENTION

A developing apparatus for a photosensitive material, specifically for a medical X-ray film will be explained below as an example of the present invention.

Figure 1:
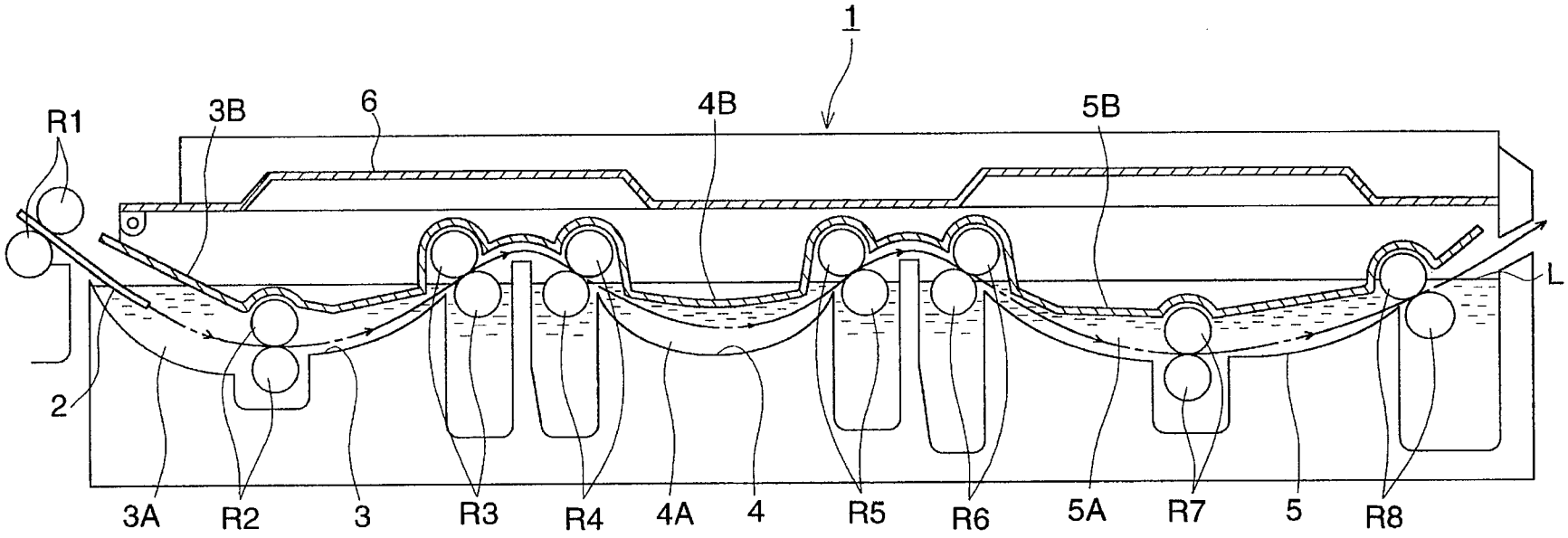
FIG. 1 is a vertical sectional view showing the arrangement of a developing tank, fixing tank, and stabilizing tank in the conveyance direction of the photosensitive material in the example of the present invention.

FIG. 1 is a sectional view showing an outline of the structure of an automatic developing apparatus 1 for an X-ray film in the conveyance direction of the X-ray film. Processing tanks, that is, a developing tank 3, fixing tank 4, and stabilizing tank 5 for stabilizing processing are laterally arranged from the left along the conveyance direction of a photosensitive material (X-ray film) 2. A development processing solution 3A, fixing solution 4A, stabilizing solution 5A are respectively accommodated in tanks. The conveyance path of the photosensitive material 2 is shown by a one-dotted chain line. The photosensitive material is conveyed by conveyance rollers shown as R1, R2, R3, R4, R5, R6, R7, R8 from the entry side. Processing solutions in respective processing tanks are filled to similar levels as in L in this example.

Three processing tanks are formed into one tank unit, and the tank unit is structured so that its height is very low or small compared with conventional tanks. The processing tanks are respectively covered by an upper surface conveyance guide section 3B of the developing tank, an upper surface conveyance guide section 4B of the fixing tank, and an upper surface conveyance guide section 5B of the stabilizing tank, and further, covered by a covering member 6 which can be opened and closed.

Figure 2:
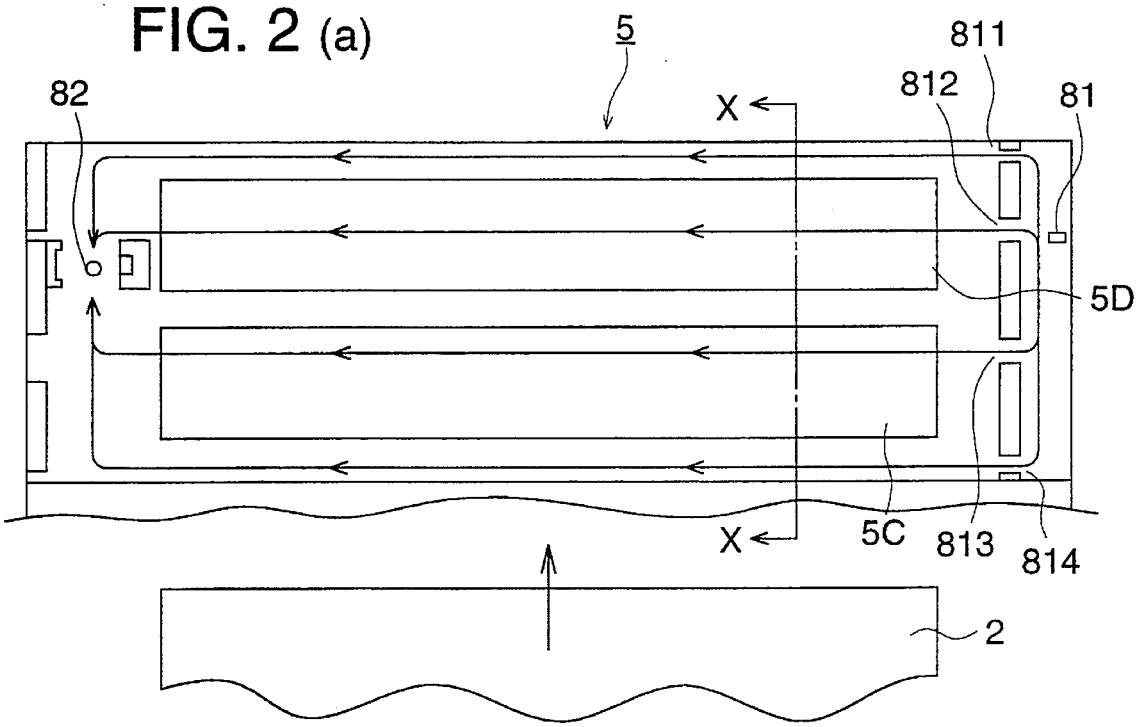
FIG. 2 (*a*) is a perspective view showing a portion of the stabilizing tank shown in FIG. 1, and specifically shows an outline of conditions of the liquid flow on the conveyance path in a processing tank.
Figure 2:
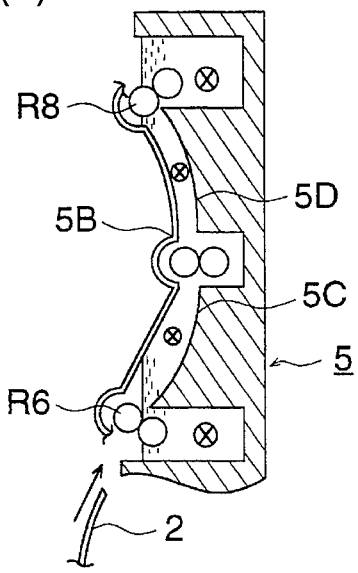

Although not shown in FIG. 1, a liquid flow is formed in the direction perpendicular to the drawing with respect to the conveyance path shown by the one-dotted chain line. This condition is shown in FIG. 2 (*a*), and FIG. 2 (*b*). FIG. 2 (*a*) is a top view showing the stabilizing tank 5, and the main portion of the liquid flow is shown by an arrowed line. A pump is connected outside the stabilizing tank as a circulating machine so that a stabilizing processing solution jetted from an outlet 81 of liquid circulation means, which is a liquid flow forming means, passes through openings 811, 812, 813, 814, and forcefully flows to the left of the drawing and is sucked into an inlet 82 provided at the left end of the stabilizing tank 5. The sectional configuration viewed from line X—X in FIG. 2 (*a*) is shown in FIG. 2 (*b*).

Two rectangular members 5C and 5D provided near the center in FIG. 2 (*a*) are lower portions of the stabilizing tank, as shown in FIG. 2 (*b*), and function as a guide member for guiding the photosensitive material 2, and are inner wall surfaces of the stabilizing tank. As shown in FIG. 2 (*b*), the liquid flow is jetted in the direction perpendicular to the drawing through openings 811 through 814 from the lateral direction with respect to the conveyance direction of the photosensitive material 2. That is, a flux of the liquid flow shown by the above apparatus is generated by openings formed at almost corresponding positions to FIG. 2 (*b*). Accordingly, in the case of the stabilizing tank, the liquid flow generated in the region of the processing tank between the entry side conveyance roller R6 and the exit side conveyance roller R8 is a requirement of the effects of the present invention in the conveyance path of the photosensitive material 2. In this example, the lateral direction with respect to the conveyance direction of the photosensitive material 2 represents a perpendicular condition to the conveyance direction. However, even when the direction of the liquid flow to the material is slightly inclined, it may be allowed when the speed of the effective perpendicular component of the liquid flow is higher than a predetermined value.

Figure 3:
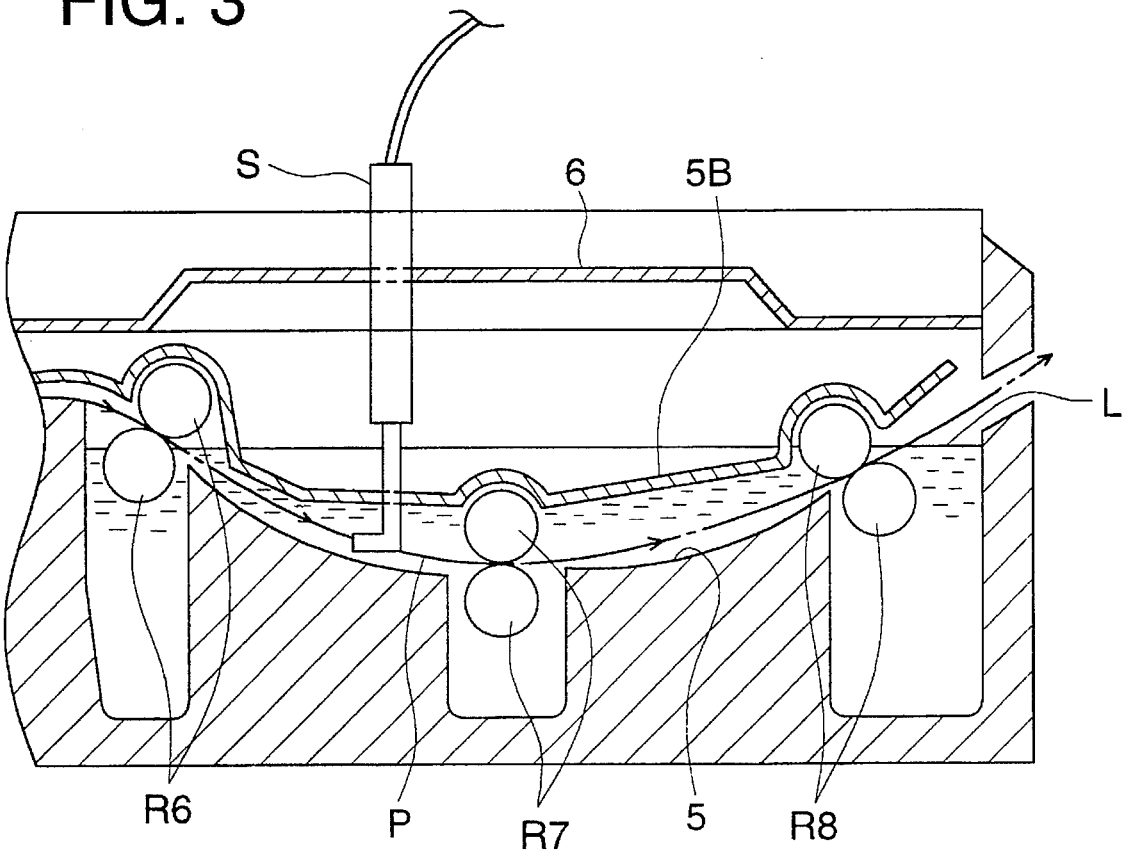
FIG. 3 is a view showing a method of measurement in the experiment.

A result of experiments of the relationship between changes of the developing performance and the speed of the liquid flow in the lateral direction when the structure of the processing tank used for the stabilizing tank is used for development processing, will be explained below. The structure used for the experiments is shown in FIG. 3, and the structure of the stabilizing tank 5 is applied to the experiments. A current meter S is prepared in order to measure the speed of the liquid flow in the lateral direction with respect to the conveyance direction in the conveyance path (one-dotted chain line), and the measuring terminal of the current meter S is fixed to a point P in the conveyance path. The electromagnetic current meter ACM-250 made by Arek Electronics Co. is used as the current meter for measuring the speed of the liquid flow.

Basically, this point P is positioned at the central portion between conveyance rollers and at the conveyance path section of the photosensitive material. That is, the current meter S is moved in the direction perpendicular to the conveyance direction of the photosensitive material, that is, in the direction perpendicular to the drawing depending on its measuring content, and the distribution of the flow speed is also measured by the current meter S. The development processing solution is supplied into the processing tank (stabilizing) 5, which is used as the developing tank, and the developing performance of this tank was checked. In this case, the influence of the flow speed in the lateral direction on the developing speed/image quality was investigated.

Since the developing property greatly influences the quality of recording medium such as a photographic film or X-ray film, and changes of the developing performance can be easily checked, experiments of the developing property were carried out, and the effects of contribution of the liquid flow in the lateral direction in the processing tank to the processing capability were checked.

Figure 8:
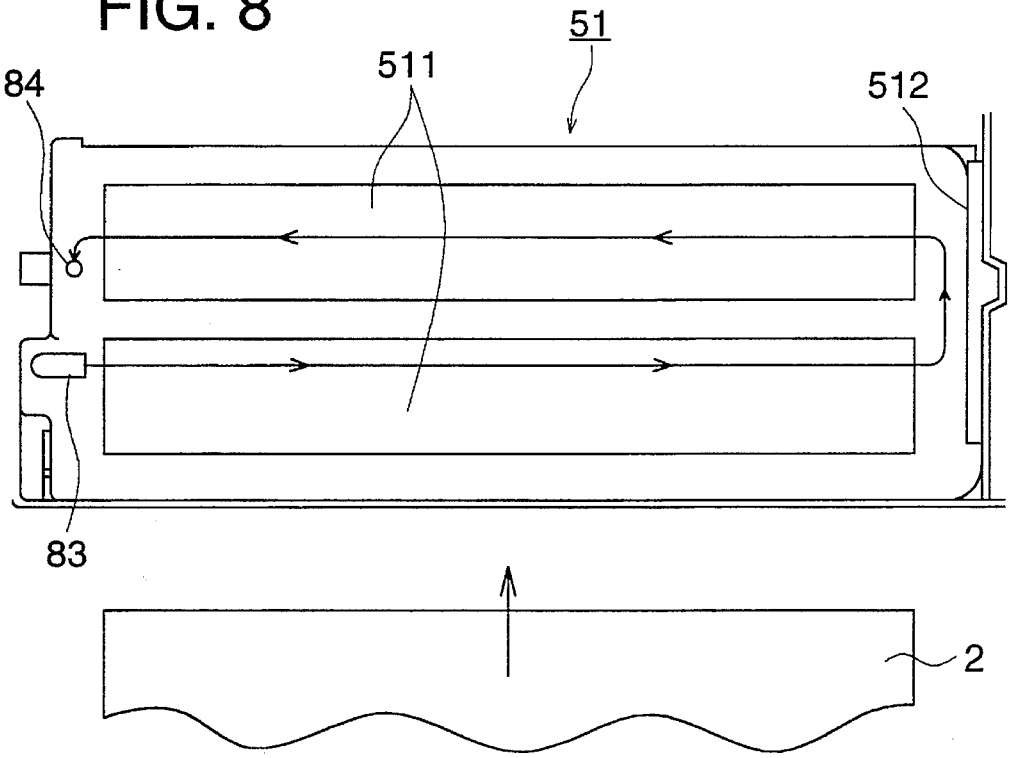
FIG. 8 is a view showing a condition of circulation of the liquid flow having one circulation path in one of the more preferable examples.

Experiments were conducted using the apparatus set up in the manner that: directions of the liquid flow are opposed to each other in the lateral direction at the front and the back of the central conveyance roller R7 with respect to the conveyance direction as shown in FIG. 8; and the jet speeds of respective liquid flows are symmetrical with respect to the center of the conveyance direction. Since the liquid flow is separated by the conveyance roller R7, the liquid flow in the reverse direction is not obstructed.

Figure 4:
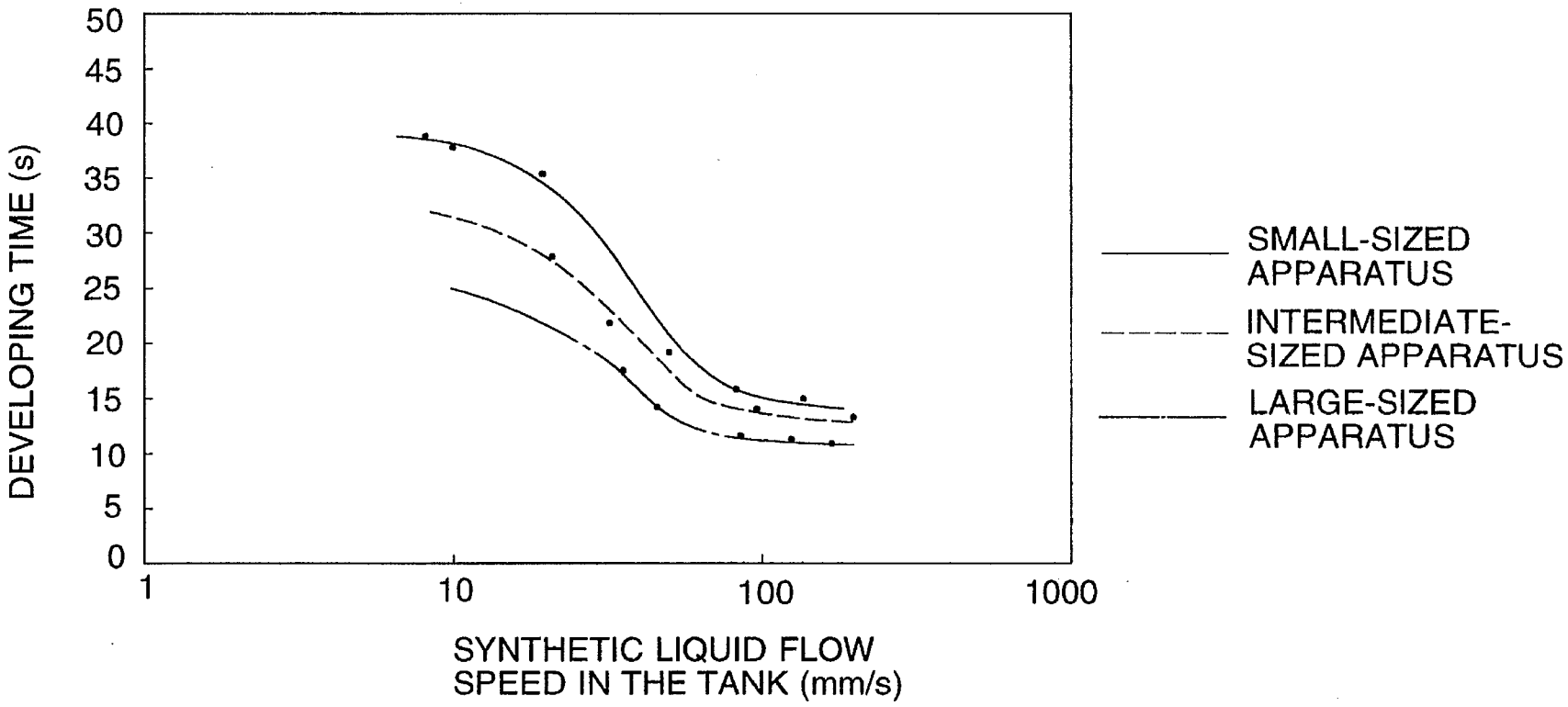
FIG. 4 is a view showing changes of the developing time at the time when the flow speed in the lateral direction is changed, in data obtained by the experiments.

In FIG. 4, the developing time was measured and plotted in the following manner: the composition of the flow speed component on the surface of the photosensitive material and the conveyance speed component of the photosensitive material is defined as the resultant synthetic flow speed in the tank; and the resultant synthetic flow speed is changed from 25 mm/sec to approximately 200 mm/sec. In this case, point P was placed at approximately the central portion in the direction of the width of the material. SRX-501 made by Konica Co. is used as a large-sized apparatus, SRX-251 made by Konica Co. is used as an intermediate apparatus, and KX-70 made by Konica Co. is used as a small-sized apparatus. Hereinafter, the flow speed and the flow speed in the tank mean this resultant synthetic flow speed. This resultant synthetic flow speed expresses a practical flow speed on the surface of the photosensitive material in this specification.

In the small-sized apparatus, the number of roller faces is 6, and the conveyance speed of the photosensitive material is 450 mm/min. In the intermediate-sized apparatus, the number of roller faces is 16, and the conveyance speed of the photosensitive material is 1100/min. In the large-sized apparatus, the number of roller faces is 28, and the conveyance speed of the photosensitive material is 2500 mm/min.

From above data, shown by a solid line, the following result was found: the developing time is suddenly reduced after the flow speed of approximately 80 mm/sec has been exceeded.

In the present invention, "the number of roller faces" is defined as the number of rollers, with which the emulsion layer of the photosensitive material is in contact. Accordingly, when the photosensitive material having two emulsion layers passes between opposing rollers, the number of roller faces is 2. When the photosensitive material having one emulsion layer passes between opposing rollers, the number of roller faces is 1. The important point in consideration of the number of roller faces is as follows: how many conveyance rollers are provided in the process, with which the surface inhibition layer is destroyed when the surface of the photosensitive materials is in contact with the rollers.

Conventionally, in small-sized apparatus, the developing time was longer because the number of roller faces could not be increased. As a result, the developing speed could not be increased because the conveyance speed was set to be low in order to allow complete developing, and the image quality was unstable. In the present invention, as described later, the image quality can also be stabilized. Further, the same critical phenomenon could be found in large-sized and intermediate-sized apparatus.

Figure 5:
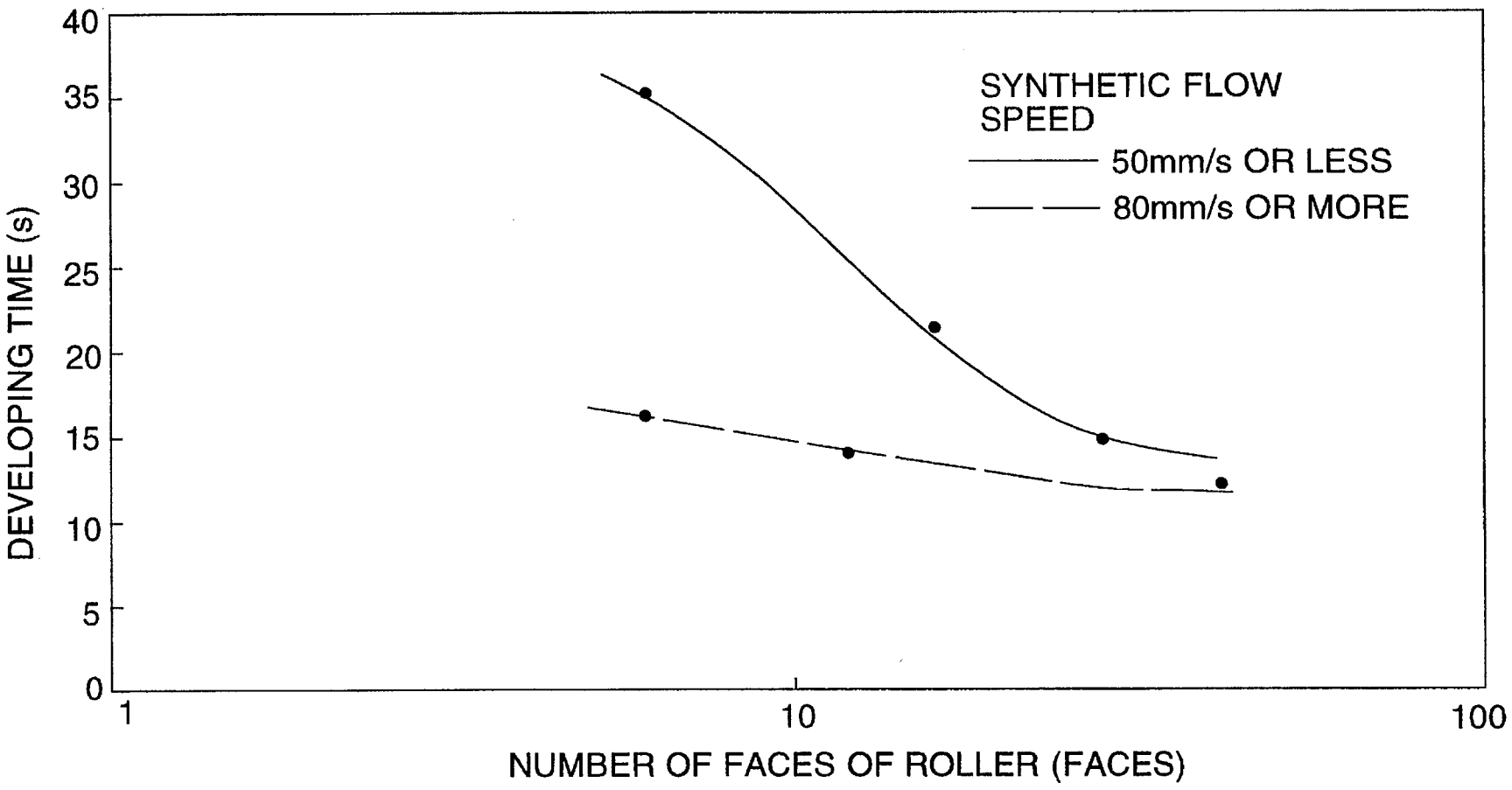
FIG. 5 is a view showing relationships of the number of contact surfaces of the conveyance rollers in the conveyance path and developing times, with respect to two kinds of flow speeds in the lateral direction.

In this case, the developing time was defined in the following way: an automatic developing apparatus (SRX-501 made by Konica), processing agents (XD-SR, XF-SR made by Konica), and film (SRG made by Konica) were used; the developing temperature was 35° C., developing time was 15 sec., resultant synthetic flow speed in the tank was 45 mm/sec, and an exposure amount $E_0$ to obtain the concentration (transmission concentration) of 1.5 was determined; the same processing agents were used, the same film was exposed by the exposure amount $E_0$, and the developing temperature was set to 35° C. for evaluation in each apparatus; and the time in which the concentration (transmission concentration) of 1.5 was obtained when the flow speed and the number of roller faces were changed, was defined as the developing time. Changes of the developing time (sec) when the number of roller faces, which is conventionally regarded as the key point for increasing the developing speed, is changed are shown in FIG. 5. The following was found: the developing time is increased considerably by the decrease of the roller faces when the resultant speed is low (shown by a solid line: 50 mm/sec) as in the conventional case; and the developing time is not much affected by the change of the number of roller faces when the resultant speed is high (shown by a dashed line: 80 mm/sec). That is, even in small-sized apparatus in which the number of roller faces is small, the developing time can be reduced and the speed can be enhanced when the resultant synthetic flow speed is raised above a predetermined value. Further, as can clearly be seen from the drawing, the following was found: the present invention is greatly effective when the resultant synthetic flow speed on the conveyance path of the photosensitive material is higher than 80 mm/sec, and the number of roller faces in the automatic developing apparatus is not larger than 35.

Figure 6:
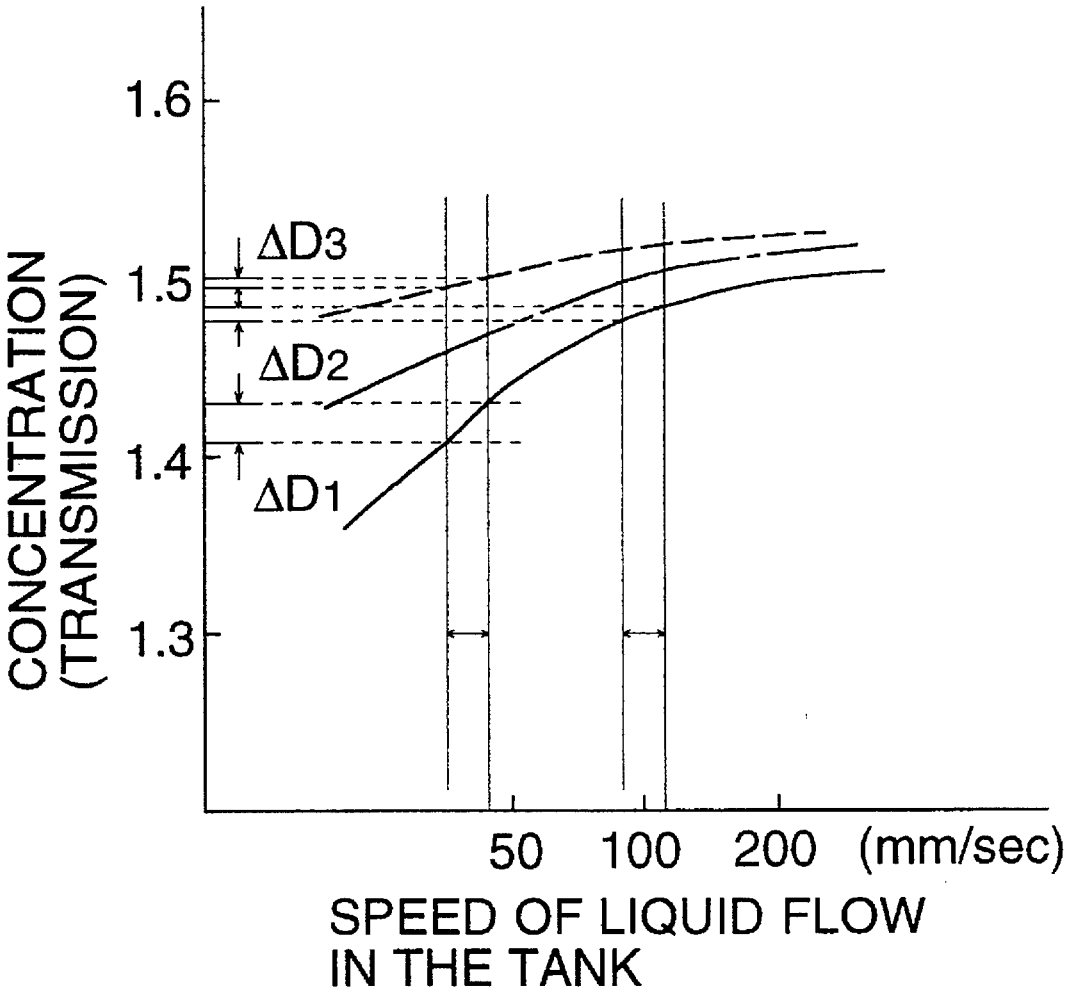
FIG. 6 is a view showing changes of development concentration in a large-sized apparatus, intermediate-sized apparatus, and small-sized apparatus to variations of the flow speed in the lateral direction in the processing tank.

FIG. 6 shows the stabilization of image quality. In the drawing, data of small-sized, intermediate-sized, and large-sized apparatus are respectively shown by a solid line, one-dotted chain line, and dashed line in the same manner as in FIG. 4. In the drawing, the speed of the liquid flow in the tank (the resultant synthetic flow speed) is shown in the lateral direction. The change of the flow speed which changes in the range, the center of which is respectively 40 mm/sec and 100 mm/sec, while the liquid flows from the outlet to the inlet is assumed to be ± 10% (in this example, the difference between the speeds of the liquid flow along the surface of the photosensitive material respectively measured at the left and right ends of the width of the material was approximately ± 10%). The range of change of the development concentration with respect to this change is assumed to be $\Delta D_1$ in small-sized apparatus when the flow speed is 40 mm/sec, and $\Delta D_2$ in small-sized apparatus when the flow speed is 100 mm/sec. In FIG. 6, the following can be found: when the speed of the liquid flow is high, the change of the concentration, that is, uneven development of the entire photosensitive material is greatly reduced. Even in the case of the large-sized apparatus, when the flow speed is 40 mm/sec, the range of the change is $\Delta D_3$. When the flow speed is high (for example, approximately 100 mm/sec) in the case of the small-sized apparatus, the degree of the uneven development is almost the same as that of the large-sized apparatus. In the large-sized apparatus, even when the resultant synthetic flow speed is increased, the uneven development, that is, the change of the developing property (change of the concentration) with respect to the change of the flow speed is hardly improved.

As described above, even when the processing apparatus is small, that is, the apparatus in which the conveyance path is short, and the number of roller faces is small, not only is the developing speed increased, but also the quality of the image, that is, the developing property in which development is carried out without any difference in the direction of width, and a stable image can be attained, when a resultant synthetic flow speed of higher than 80 mm/sec is formed with respect to the conveyance direction of the photosensitive material. Of course, when not only the difference in the direction of width, but also the change of the flow speed does not affect the concentration, it is preferable for the entire processing quality.

Figure 7:
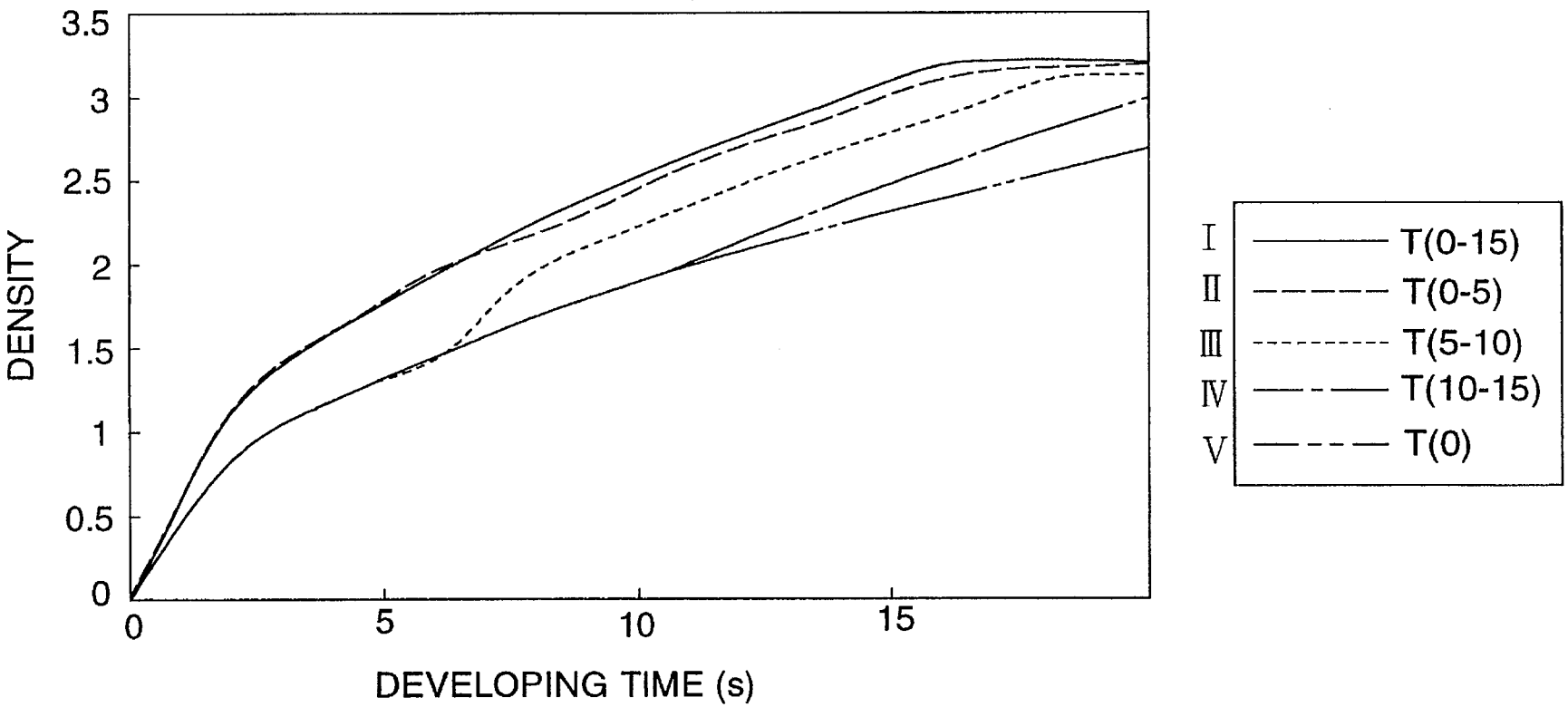
FIG. 7 is a diagram showing a relation between a timing of creating a liquid flow and a development progressing property.

FIG. 7 shows the development progressing property in the case where the resultant synthetic flow speed directed onto the film surface is made constant (80 mm/sec) and the timing to get the resultant synthetic flow speed is changed. In FIG. 7, line I is a graph showing the concentration when the predetermined flow speed is directed onto the film surface for 15 sec. after the start of the development. In the same way, line II is a graph showing the concentration when the predetermined flow speed is directed onto the film surface for 5 sec. after the start of the development, and line III is a graph in the case where the flow speed is directed for only 5 sec. after 5 sec. has passed after the start of the development. Line IV is a graph in the case where the predetermined flow speed is directed while only additional 5 sec. pass after 10 sec. have passed after the start of the development. As can clearly be seen from the drawing, the following was found: when the predetermined flow speed is directed onto the film surface, it is effective for the development; and when the period of time to get the flow speed is the same, it is better for the development progressing property to get the flow speed at the initial stage of the developing process. Accordingly, it is preferable that the liquid flow forming means is provided in the upstream portion of the processing tank in which, at least, the development is carried out.

As can clearly be seen from FIG. 7, line I shows the highest concentration of the processing solution obtained after the development processing has been completed, and next highest in concentration are line II, line III, and line IV in turn, wherein developing time means a period of time elapsed from the time in which the leading edge of the photosensitive material to be developing processed has entered into the processing solution, to the time in which the developing processing is completed and the leading edge is delivered from the processing solution. In this embodiment, the developing time is 15 sec. Further, the following is clearly found: the concentration of the processing solution is the lowest in the case where the resultant synthetic flow speed of 80 mm/sec is not directed onto the photosensitive material on the conveyance path, (line V). Accordingly, the following was found: when a resultant synthetic flow speed of more than the predetermined value is directed onto the photosensitive material at any time during developing processing, this greatly contributes to an increase of concentration in the processing solution. This is equivalent to a decrease of the developing time.

In detail, the following was found preferable when the resultant synthetic flow speed of more than the predetermined value is directed onto the photosensitive material on the conveyance path before ⅔ of the overall developing time passes after the start of development. More preferably, the resultant synthetic flow speed of more than the predetermined value is directed to the photosensitive material on the conveyance path before ⅓ of the overall developing time passes after the start of development. Still more preferably, the resultant synthetic flow speed of more than the predetermined value is continuously directed onto the photosensitive material on the conveyance path until ⅓ of the overall developing time passes after the start of development. More preferably still, the resultant synthetic flow speed of more than the predetermined value is continuously directed to the photosensitive material on the conveyance path until ⅔ of the overall developing time passes after the start of the development. Needless to say, it is preferable that the resultant synthetic flow speed on the conveyance path of the photosensitive material is always more than the predetermined value during developing processing.

In this connection, in FIG. 7, each of lines I through V shows the change of concentration after 15 sec. have passed. That is, each line shows the change of the concentration in the case where developing is continuously processed after 15 sec. have passed.

Specific examples of other processing apparatus will be described below.

FIG. 8 is a plan view of the processing tank. The liquid jetted out from the outlet 83 is circulated as shown by an arrowed line on the lower conveyance guide surfaces of the processing tank shown by numeral 511 in the processing tank 51. The direction of the liquid flow is changed by a reflection portion 512 at the side opposed to the outlet with respect to the conveyance direction of the photosensitive material 2, and the liquid flows to the inlet 84 provided at the same side as the outlet. The flow speed of the liquid is lowered as it progresses from the outlet, and when the liquid is circulated in this way, the relationship in which the the flow speeds of the liquid compensate each other with respect to the direction of the width of the photosensitive material can be obtained and it contributes to the image quality. In this case, one circulation path is provided in this apparatus, and therefore, the structure is simplified. The reflection portion 512 on the inner wall of the processing tank may be made concave and curved so that the direction of the liquid flow is changed smoothly. By the structure for forming the liquid flow shown in FIG. 8, experiments for the development performance were conducted.

Figure 9:
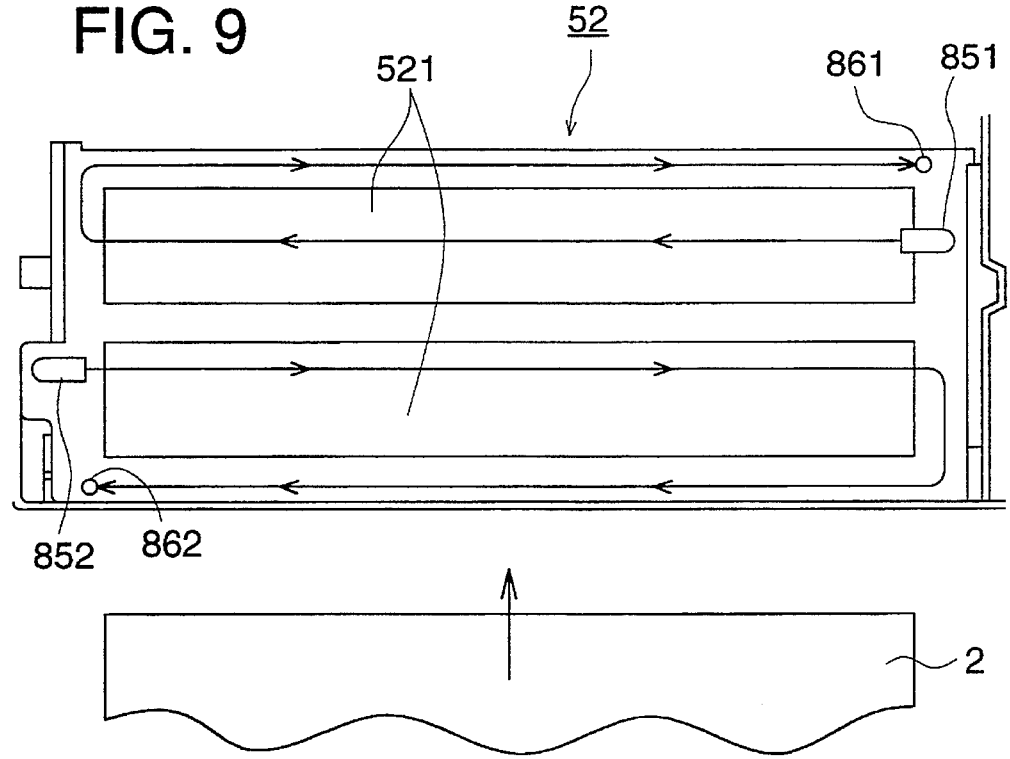
FIG. 9 is a view showing a condition of circulation in an example having two circulation paths.

FIG. 9 shows a structure having two liquid flow circulation paths. In the processing tank 52, two outlets 851 and 852 are provided at sides opposed to each other in the direction of the width (both the left and right directions of the drawing) with respect to the conveyance direction. The liquid flow is circulated clockwise in the upstream side of the conveyance direction of the photosensitive material 2, while the liquid flow is circulated counterclockwise in the downstream side of the conveyance direction. Specifically, the high speed liquid flow just after the jet, flows on the lower side conveyance guide surfaces shown by numeral 521. The photosensitive material 2 is positioned on these lower side conveyance guide surfaces 521. The speed of the liquid flow on this portion is important, and the flow speed of 80 mm/sec is provided over the entire range in the direction of the width in this example. In this way, an extremely high image quality can be obtained, and the developing speed can be greatly enhanced, so that high speed processing can be conducted.

The liquid flows as shown by the arrowed line, and is sucked into respective inlets 861 and 862 and circulated. The liquid flows in the opposed directions can be separated by the roller as described above, or when partitions are provided on the conveyance guide surfaces 521, these liquid flows can be separated.

Figure 10:
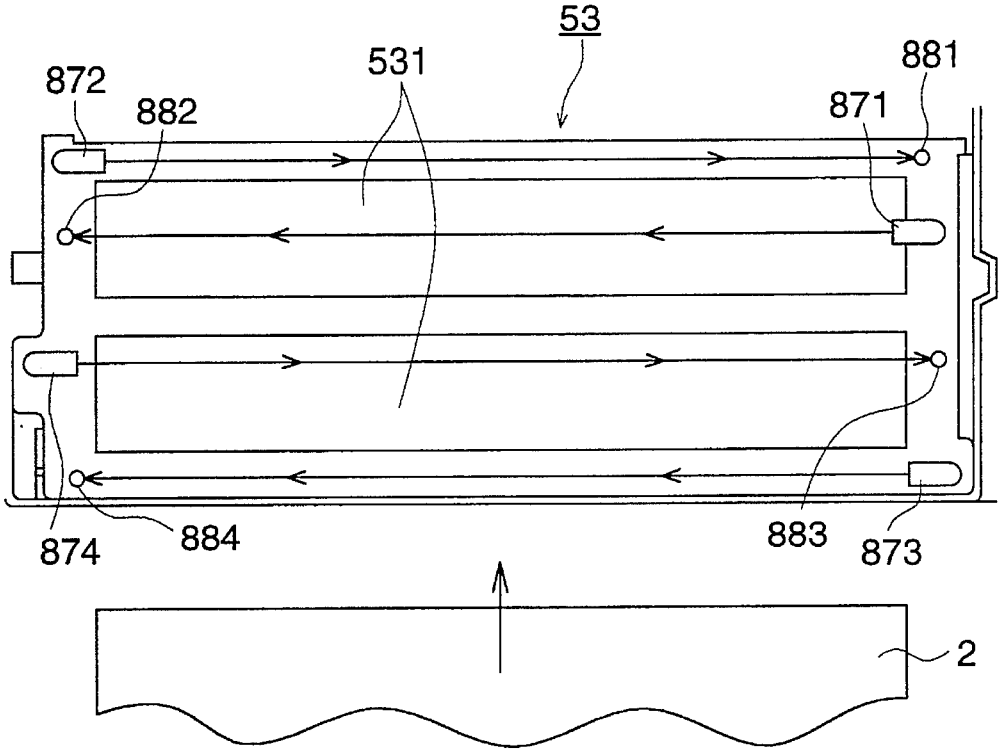
FIG. 10 is a view showing the condition of circulation of an example having four circulation paths.

In FIG. 10, the liquid flow is formed in the following manner: respective single circulation paths are formed at the entry and exit portions of the photosensitive material in the processing tank 53 shown in the plan view, not at the conveyance path of the photosensitive material 2, so that further circulation of the processing solution can be carried out. The liquid respectively flows from the outlet 872 to the inlet 881, and from the outlet 873 to the inlet 884. Since the conveyance path of the photosensitive material is formed on the lower conveyance guide surfaces 531, the principal liquid flows are formed between outlets 871, 874 and inlets 882, 883, in the present invention. In this example, since the left and right variations of the distribution of the flow speed in the direction of the width in the conveyance path of the photosensitive material is small as compared with those in the structure in FIG. 9, the image quality can be enhanced although components of the apparatus are increased.

Figure 11:
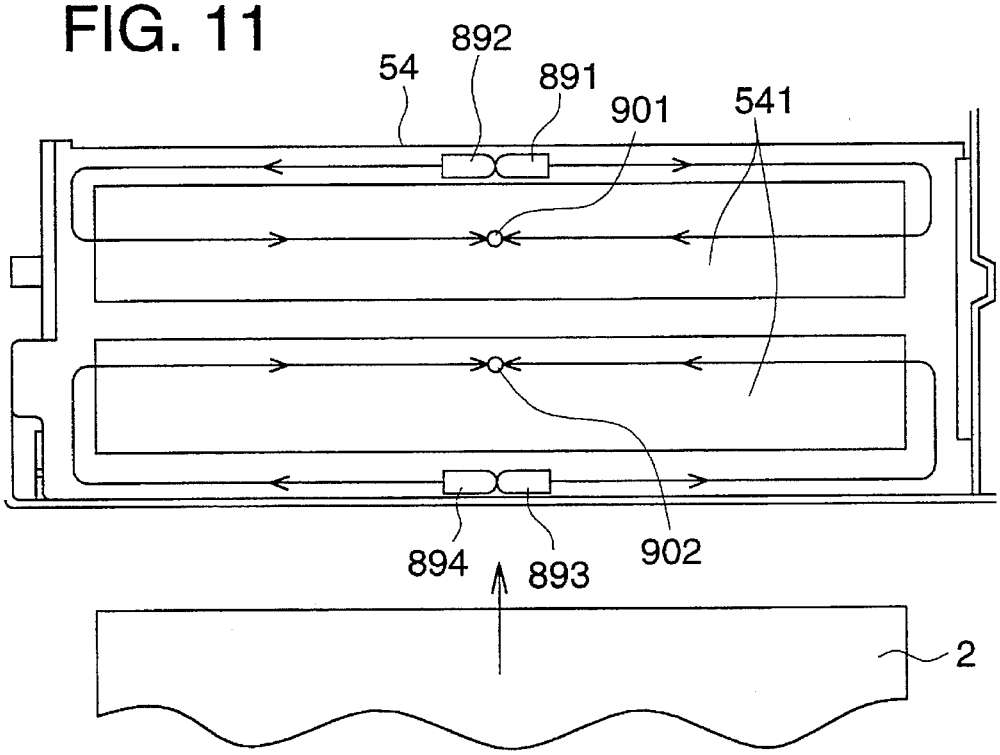
FIG. 11 is a view showing a condition of circulation of another example having four circulation paths.
Figure 12:
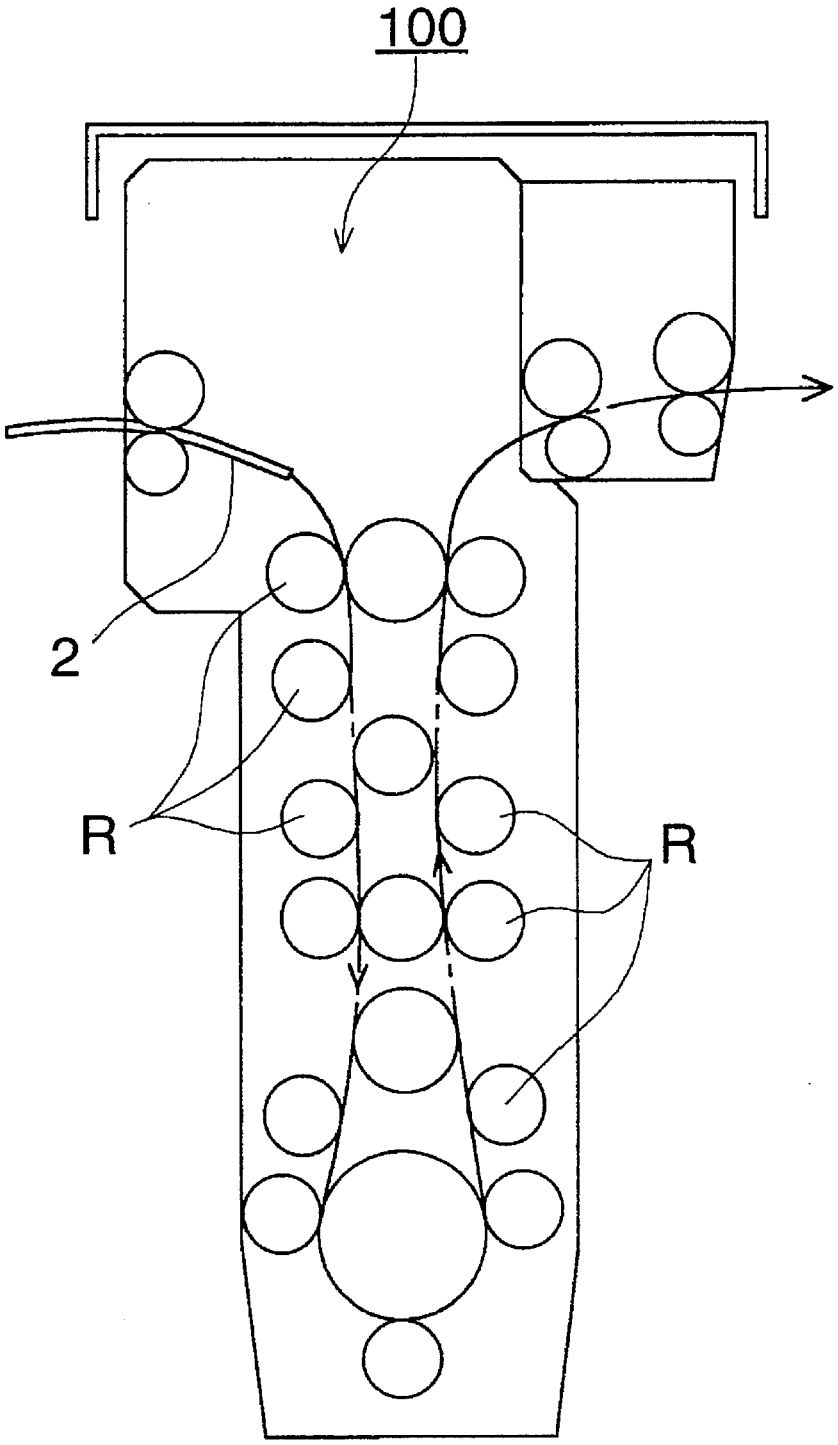
FIG. 12 is a vertical sectional view showing a conventional processing tank.

In FIG. 11, pairs of outlets 891, 892, and 893, 894 are provided at the central portions in the direction of the width of the photosensitive material 2 in the processing tank 54 in the manner that the liquids are respectively jetted from each pair of outlets to the opposed end portions in the direction of the width, and two inlets 901, 902 are respectively provided above the lower side conveyance guide surfaces 541 in the manner that one inlet is used by two outlets, as the liquid circulation paths.

In the above examples, the processing vessel comprises two sides parallel to the conveying direction and, the liquid circulation means has inlets at one or both sides, however, the liquid circulation means may have only the outlet.

Further, in the above examples, a liquid flow or a solution flow is created in a direction substantially perpendicular to the conveying direction of the photosensitive materials by the solution flow forming means. By creating a solution flow having a synthetic flow speed not less than 80 mm/sec and a flow speed not less than 40 mm/sec in a direction perpendicular to the conveying direction, it has been found that there is an effect against the uneven processing in the widthwise direction.

As described above, in a processing apparatus represented by an automatic developing apparatus, when material represented by photosensitive material is processed by developing, fixing and stabilizing, the present invention is structured as follows: processing solution is jetted in the direction which is perpendicular to the conveyance direction of the photosensitive material and along the surface of the photosensitive material; the processing solution is circulated in the direction of the width when the inlet is used; and the flow of the processing solution in the direction of the width is extremely enhanced. Accordingly, even when dimensions of the processing apparatus are small, and the number of the conveyance rollers is small, the stable processing quality, such as for development, can be attained, and the processing time can be reduced. Accordingly, it takes a very short period of time until the inserted material to be processed is developed and discharged, and speed-up of the processing can be attained.

It is very significant that the high image quality can be maintained and the speed-up of processing can be attained even when a small-sized apparatus is used.

Specifically, in the photosensitive material for medical X-ray images, the image density is very important and the image quality becomes a major concern. Silver halide photosensitive emulsion is coated on the front and rear surface of X-ray film, and the processing solution flows on both the front and rear surface of the material in the conveyance path when the processing solution is supplied from the two-way lateral directions in the present invention, so that a large processing effect can be obtained.

As shown above, various examples for development processing have been described. The present invention can be used not only for X-ray film or color photographic film, but also for an apparatus in which various materials are processed by the liquid processing agent.

Since development processing can be fully carried out by a small-sized and shallow processing tank, a processing unit, the height of which is small, can be attained as shown in FIG. 1. Accordingly, the conveyance path of the photosensitive material becomes almost horizontal, wrinkling is reduced, jamming is reduced at the high speed conveyance, and even rather hard material can be more easily conveyed, so that the range of use can be extended.

What is claimed is:

1. An apparatus for processing a photosensitive material, comprising:

a processing vessel in which a developing solution used to develop the photosensitive material is stored;

conveyance means for conveying the photosensitive material in a predetermined conveying direction in the processing vessel; and solution flow forming means for creating a flow of the developing solution on a surface of the photosensitive material, wherein a synthetic flow speed on a surface of the photosensitive material is not less than 80 mm/sec, the synthetic flow speed is a composition of a flow speed component by the solution flow forming means and a conveyance speed component by the conveyance means.

2. The apparatus of claim 1, wherein the solution flow forming means creates a first flow in a first flow direction which crosses the conveying direction at a part of the conveyance passage and a second flow in a second flow reverse to the first flow direction at another part of the conveyance passage.

3. The apparatus of claim 2, wherein the solution flow forming means comprises a discharge port through which the processing solution is introduced to the solution vessel and a suction port through which the processing solution is sucked into the solution flow forming means.

4. The apparatus of claim 3, wherein the processing vessel comprises two sides parallel to the conveying direction.

5. The apparatus of claim 4, wherein the discharge port and the suction port are located at the same side of the processing tank so that the processing solution is circulated from the first flow to the second flow.

6. The apparatus of claim 1, wherein the synthetic flow speed of the processing solution is not less than 80 mm/sec through out the conveyance passage.

7. The apparatus of claim 1, wherein the direction of the flow created by the solution flow forming means is perpendicular to the conveying direction.

8. The apparatus of claim 7, wherein the first flow speed and the second flow speed are in a complemental relation.

9. The apparatus of claim 2, wherein the flow direction of the first and second flows is perpendicular to the conveying direction.

10. The apparatus of claim 1, wherein the conveying means comprises rollers and the rollers have faces not larger than 35 pieces.

11. The apparatus of claim 1, wherein the photosensitive material is processed for a developing time period in the processing vessel.

12. The apparatus of claim 1, wherein the first discharge port is located at one side of the processing vessel and the first suction port is located at the other side of the processing vessel so as to create the first flow and the second discharge port is located at the other side of the processing vessel and the second suction port is located at the one side of the processing vessel so as to create the second flow.

13. An apparatus for processing a photosensitive material, comprising:

a processing vessel in which a processing solution used to process the photosensitive material is stored;

conveyance means for conveying the photosensitive material in a predetermined conveying direction in the processing vessel; and solution flow forming means for creating a flow of the processing solution on a surface of the photosensitive material, wherein a synthetic flow speed on a surface of the photosensitive material is not less than 80 mm/sec, the synthetic flow speed is a composition of a flow speed component by the solution flow forming means and a conveyance speed component by the conveyance means, and wherein (i) the solution flow forming means creates a first flow in a first flow direction which crosses the conveying direction at a part of the conveyance passage and a second flow in a second flow reverse to the first flow direction at another part of the conveyance passage, (ii) the solution flow forming means comprises a first and a second discharge port through which the processing solution is introduced to the solution vessel and a first and a second suction port through which the processing solution is sucked into the solution flow forming means, (iii) the processing vessel comprises two sides parallel to the conveying direction, and (iv) the first discharge port is located at one side of the processing vessel and the first suction port is located at the other side of the processing vessel so as to create the first flow and the second discharge port is located at the other side of the processing vessel and the second suction port is located at the one side of the processing vessel so as to create the second flow.

14. An apparatus for processing a photosensitive material, comprising:

a processing vessel in which a processing solution used to process the photosensitive material is stored;

conveyance means for conveying the photosensitive material in a predetermined conveying direction in the processing vessel, and solution flow forming means for creating a flow of the processing solution on a surface of the photosensitive material, wherein a synthetic flow speed on a surface of the photosensitive material is not less than 80 mm/sec, the synthetic flow speed is a composition of a flow speed component by the solution flow forming means and a conveyance speed component by the conveyance means;

the solution flow forming means creates a first flow in a first flow direction which crosses the conveying direction at a part of the conveyance passage and a second flow in a second flow reverse to the first flow direction at another part of the conveyance passage;

the solution flow forming means comprises a discharge port through which the processing solution is introduced to the solution vessel and a suction port through which the processing solution is sucked into the solution flow forming means;

the processing vessel comprises two sides parallel to the conveying direction;

the discharge port and the suction port are located at the same side of the processing tank so that the processing solution is circulated from the first flow to the second flow; and the solution flow forming means creates two lines of circulating flows.

15. An apparatus for processing a photosensitive material, comprising:

a processing vessel in which a processing solution used to process the photosensitive material is stored;

conveyance means for conveying the photosensitive material in a predetermined conveying direction in the processing vessel; and solution flow forming means for creating a flow of the processing solution on a surface of the photosensitive material, wherein a synthetic flow speed on a surface of the photosensitive material is not less than 80 mm/sec., the synthetic flow speed is a composition of a flow speed component by the solution flow forming means and a conveyance speed component by the conveyance means; and wherein the solution flow forming means creates a first flow in a first flow direction which crosses the conveying direction at a part of the conveyance passage and a second flow in a second flow reverse to the first flow direction at another part of the conveyance passage;

the solution flow forming means comprises a discharge port through which the processing solution is introduced to the solution vessel and a suction port through which the processing solution is sucked into the solution flow forming means;

the processing vessel comprises two sides parallel to the conveying direction; and the discharge port is located at a middle point between two sides of the processing vessel and the suction port is located at another middle point between two sides of the processing vessel so that the processing solution is circulated from the first flow to the second flow.

16. An apparatus for processing a photosensitive material, comprising;

a processing vessel in which a processing solution used to process the photosensitive material is stored;

conveyance means for conveying the photosensitive material in a predetermined conveying direction in the processing vessel; and solution flow forming means for creating a flow of the processing solution on a surface of the photosensitive material, wherein a synthetic flow speed on a surface of the photosensitive material is not less than 80 mm/sec., the synthetic flow speed is a composition of a flow speed component by the solution flow forming means and a conveyance speed component by the conveyance means, and wherein the solution flow forming means creates a first flow in a first flow direction which crosses the conveying direction at a part of the conveyance passage and a second flow in a second flow reverse to the first flow direction at another part of the conveyance passage; and if a first flow speed at a point of the first flow and a second flow speed at a corresponding point on the second flow are assumed in which the point on the first flow and the corresponding point on the second flow are on the same conveying line on the conveying passage, the sum of the first flow speed and the second flow speed on each conveying line throughout the width of the conveying passage is made substantially equal to each other.

17. An apparatus for processing a photosensitive material, comprising:

a processing vessel in which a processing solution used to process the photosensitive material is stored;

conveyance means for conveying the photosensitive material in a predetermined conveying direction in the processing vessel; and solution flow forming means for creating a flow of the processing solution on a surface of the photosensitive material, wherein a synthetic flow speed on a surface of the photosensitive material is not less than 80 mm/sec, the synthetic flow speed is a composition of a flow speed component by the solution flow forming means and a conveyance speed component by the conveyance means and wherein the photosensitive material is processed for a developing time period in the processing vessel and the synthetic flow speed not less than 80 mm/sec is created in a period up to or during a period of ⅔ of the developing time period.

18. The apparatus of claim 17, wherein the synthetic flow speed not less than 80 mm/sec is created at a time before ⅔ of the developing time period.

19. The apparatus of claim 17, wherein the synthetic flow speed not less than 80 mm/sec is created at a time before ⅓ of the developing time period.

20. The apparatus of claim 17, wherein the synthetic flow speed not less than 80 mm/sec is created during a period of ⅓ of the developing time period.

21. The apparatus of claim 17, wherein the synthetic flow speed not less than 80 mm/sec is created during a period of ⅔ of the developing time period.

* * * * *